US009783387B2

(12) United States Patent
Matsuyama et al.

(10) Patent No.: US 9,783,387 B2
(45) **Date of Patent: *Oct. 10, 2017**

(54) SHEET BEHAVIOR MONITOR FOR SHEET PROCESSOR

(75) Inventors: Shinya Matsuyama, Noda (JP); Tadahiko Iino, Tsukuba (JP)

(73) Assignee: KOMORI CORPORATION, Tokyo (JP)

( * ) Notice: Subject to any disclaimer, the term of this patent is extended or adjusted under 35 U.S.C. 154(b) by 1204 days.

This patent is subject to a terminal disclaimer.

(21) Appl. No.: 12/464,338

(22) Filed: May 12, 2009

(65) Prior Publication Data

US 2009/0295915 A1 Dec. 3, 2009

(30) Foreign Application Priority Data

May 28, 2008 (JP) ..... 2008-138976

(51) Int. Cl.
*B65H 43/08* (2006.01)

(52) U.S. Cl.
CPC ..... *B65H 43/08* (2013.01); *B65H 2511/522* (2013.01); *B65H 2513/50* (2013.01); *B65H 2553/42* (2013.01); *B65H 2701/1123* (2013.01); *B65H 2701/13214* (2013.01); *B65H 2701/1932* (2013.01)

(58) Field of Classification Search
CPC ..... H04L 13/184; H04N 1/00572
See application file for complete search history.

(56) References Cited

U.S. PATENT DOCUMENTS

| | | | | |
|---|---|---|---|---|
| 5,095,252 | A | 3/1992 | Kurth | |
| 6,192,140 | B1 * | 2/2001 | Reinhard et al. | 382/112 |
| 8,186,662 | B2 * | 5/2012 | Matsuyama | B65H 45/18 270/4 |
| 2002/0158769 | A1 * | 10/2002 | Ikeda et al. | 340/675 |
| 2006/0279803 | A1 * | 12/2006 | Wilsher et al. | 358/474 |
| 2009/0168125 | A1 * | 7/2009 | Wilson | H04N 1/00572 358/496 |

FOREIGN PATENT DOCUMENTS

| | | |
|---|---|---|
| JP | 2000-95431 A | 4/2000 |
| JP | 2003-300668 A | 10/2003 |

OTHER PUBLICATIONS

European Search Report issued in European Patent Application No. 09159616.3 on Sep. 5, 2012.

* cited by examiner

*Primary Examiner* — Larry Donaghue
(74) *Attorney, Agent, or Firm* — Birch, Stewart, Kolasch & Birch, LLP

(57) ABSTRACT

A sheet behavior monitor for a sheet processor includes: a folding machine processing a sheet; and a camera taking an image once for each signature (Wb) folded by the folding machine. The camera takes every image at a folding machine rotation phase different from that of the image immediately before taken.

2 Claims, 16 Drawing Sheets

VIEW FROM ARROW A

VIEW FROM ARROW B

VIEW FROM ARROW C

SHEET BEHAVIOR MONITOR FOR SHEET PROCESSOR

TECHNICAL FIELD

The present invention relates to a sheet behavior monitor for a sheet processor such as a folding machine attached to a rotary offset printing press.

BACKGROUND ART

A rotary offset printing press includes a folding machine which cuts a web into pieces of a predetermined length and folds the web in a width direction and in a length direction, after the web is printed by a print unit and dried and cooled by a drying and cooling unit (see, for example, Patent Literature 1).

Folding methods implemented by the folding machine include: former folding for folding a web before being cut in two in a width direction by a former; single-parallel folding for folding a signature cut from the web in two in a length direction between a folding cylinder and a first jaw cylinder; double-parallel folding (folding in four) for further folding the single-parallel folded signature in two in the length direction between the first jaw cylinder and a second jaw cylinder; delta-folding (rolling folding) for firstly folding a signature, at a one-third position in a width direction, in two in the length direction between the folding cylinder and the first jaw cylinder and then further folding the signature in two in the length direction between the first and second jaw cylinders; and chopper folding for folding the single-parallel folded, double-parallel folded or delta-folded signature in two in a direction parallel to a conveying direction of the signature by use of a chopper. These folding methods are selected to be used independently or in combination according to the specification of the signature.

Here, particularly consider the signature parallel-folded between the folding cylinder and the first jaw cylinder in the folding machine described above. The signature is cut off from a web between a cut-off cylinder and the folding cylinder while a sheet conveying direction end of the signature is being held by needles of the folding cylinder, and then is folded at a center portion by a sucker blade of the folding cylinder and a gripper board of the first jaw cylinder. Thus, even after passing through a contact point (folding position) between the folding cylinder and the first jaw cylinder, the end held by the needles of the folding cylinder is conveyed along a circumferential surface of the folding cylinder to the folding cylinder side. Thereafter, the end is released from the needles of the folding cylinder, and the signature is held at the center portion by the gripper board of the first jaw cylinder and is conveyed toward the first jaw cylinder.

In this way, the end of the signature is conveyed once along the circumferential surface of the folding cylinder to the folding cylinder side, and then is pulled back to and conveyed toward the first jaw cylinder. Thus, the end of the signature (in other words, a trailing edge of a sheet) is conveyed so unstably that the end of the signature may be caught and torn by the following needles of the folding cylinder or may be folded at a corner. The end of the signature similarly is conveyed unstably in a range where the signature is parallel-folded between the first and second jaw cylinders and where the conveying direction end of the signature is similarly pulled back.

CITATION LIST

[Patent Literature 1]
Japanese Patent Application Publication No. 2000-95431

SUMMARY OF INVENTION

Technical Problem

To avoid this, it is conceivable that an operator monitors a behavior of the signature described above by taking images of the behavior with a camera.

One possible way of monitoring behaviors of signatures when folding the signature is to take images of the signatures by the camera once for each signature at the same rotation phase, and to monitor the images sequentially displayed on a display. With this way, however, the behaviors of the signature at other rotation phases cannot be monitored. This leads to a problem that determination cannot be made on whether or not the overall behavior of the signature is good.

To avoid this, like normal continuous shots, images of one signature may be continuously taken by a general camera and be sequentially displayed. However, this still arises a problem that the operator cannot recognize the behaviors since a rotation speed of the folding machine of the rotary offset printing press is as high as 1000 rpm.

The present invention has solved the above problems in such a manner that images of sheets are taken by a camera by delaying a timing every time by a period corresponding to a certain rotation phase and are displayed in chronological order so that the behaviors of the sheets can be displayed as frame advance images.

Solution to Problem

An aspect of the present invention provides a sheet behavior monitor for a sheet processor, including: a sheet processor processing a sheet; and imaging means taking an image once for each sheet processed by the sheet processor. In the sheet behavior monitor for a sheet processor, the imaging means takes every image at a sheet processor rotation phase different from that of the image immediately before taken.

Moreover, in the sheet behavior monitor for a sheet processor, the imaging means takes every image at a later point in the sheet processor rotation phase than that of the image immediately before taken.

Moreover, in the sheet behavior monitor for a sheet processor, the later point in the sheet processor rotation phase is later by a certain rotation phase than that of the image immediately before taken.

Moreover, the sheet behavior monitor for a sheet processor further includes: a display, and in the sheet behavior monitor for a sheet processor, the display displays the images taken by the imaging means in chronological order.

Moreover, in the sheet behavior monitor for a sheet processor, the display is provided in an operation stand operated by an operator.

Advantageous Effects of Invention

According to the present invention having the above configuration, the imaging means takes every image at a sheet processor rotation phase different from that of the image immediately before taken. Thus, the behavior of the sheet can be comprehensively grasped. Moreover, the images are not displayed at high speed unlike the case where images of one sheet are taken as normal continuous shots taken by a camera. Thus, the operator can easily recognize the behavior.

Moreover, the imaging means takes every image at a later point in the sheet processor rotation phase than that of the image immediately before taken. Thus, the operator can easily recognize the behavior of the sheet along the flow thereof.

Moreover, since the later point in the sheet processor rotation phase is later by a certain rotation phase than that of the image immediately before taken, the operator can reliably recognize the behavior of the sheet along the flow thereof.

Moreover, the display is provided to display the images taken by the imaging means in chronological order. Thus, the behavior of the sheet can be displayed as so-called frame advance images on the display. As a result, the operator can easily recognize the behavior.

Moreover, since the display is provided in an operation stand operated by the operator, monitoring by the operator is facilitated.

DESCRIPTION OF EMBODIMENTS

With reference to the drawings, a sheet behavior monitor for a sheet processor according to the present invention will be described in detail below based on an embodiment.

EXAMPLES

Figure 1:
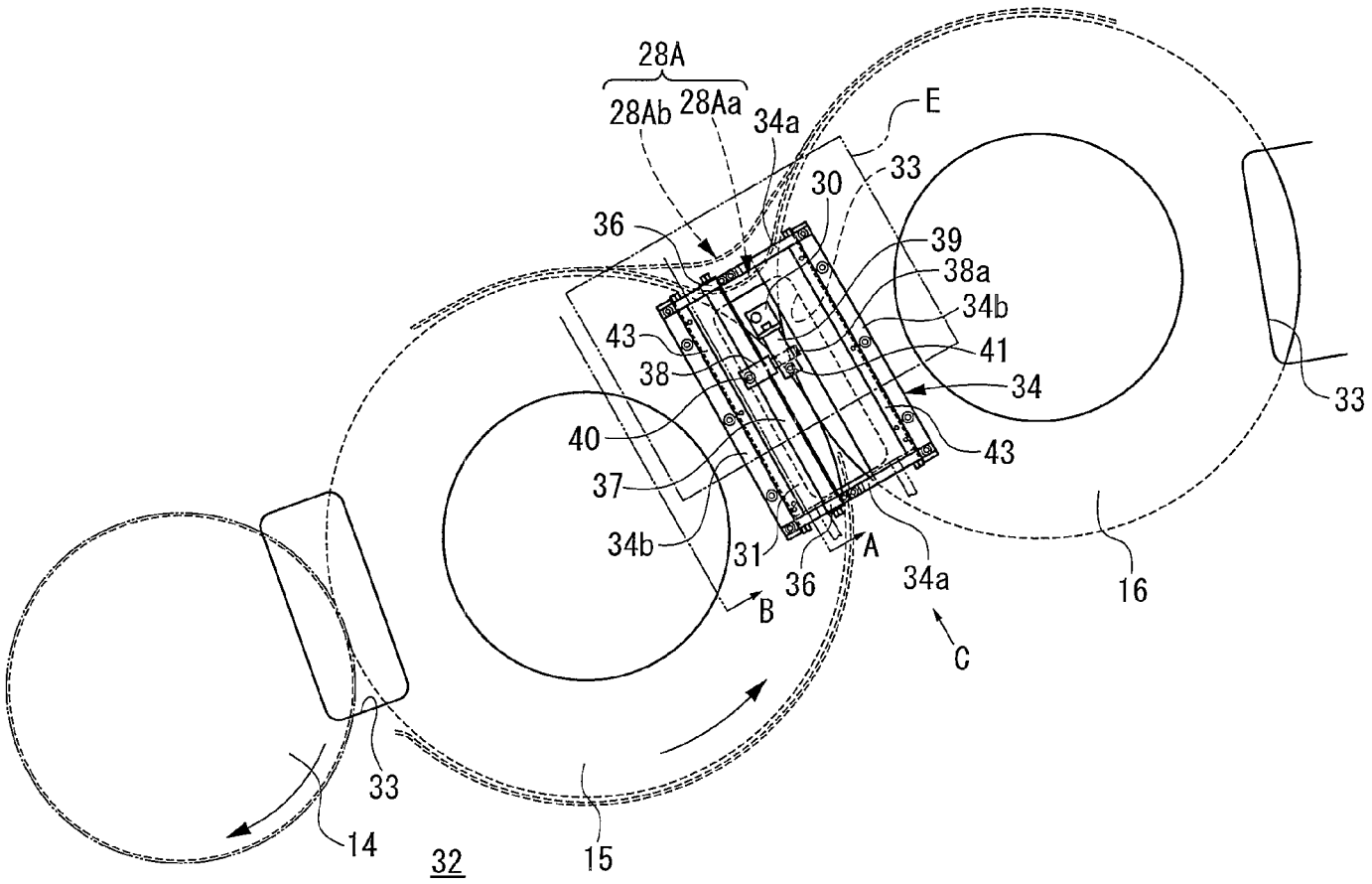
FIG. 1 is a side view of a parallel folding device (gripper folding device) in a folding machine according to an embodiment of the present invention.
Figure 2:
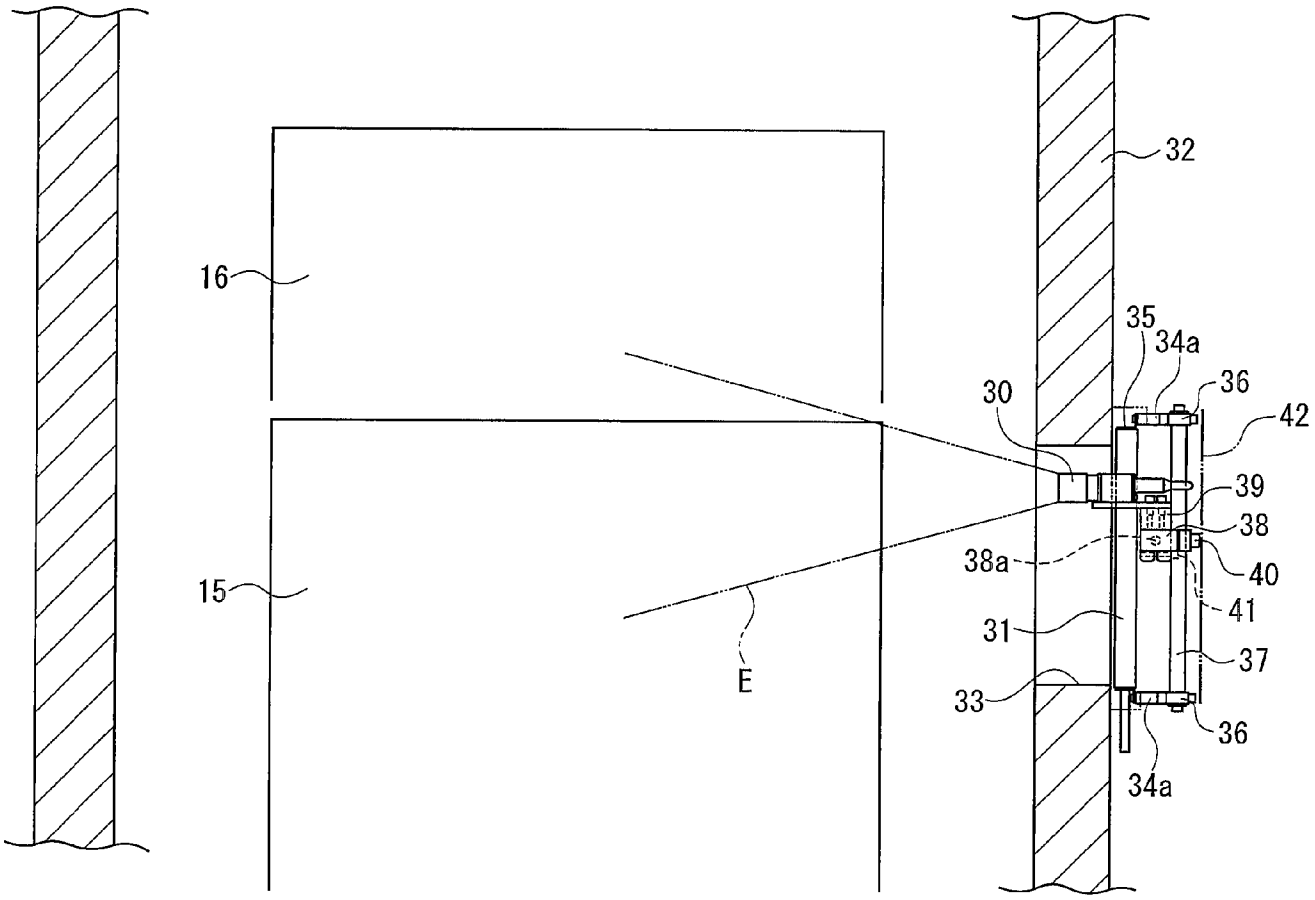
FIG. 2 is a view seen from an arrow A in FIG. 1.
Figure 3:
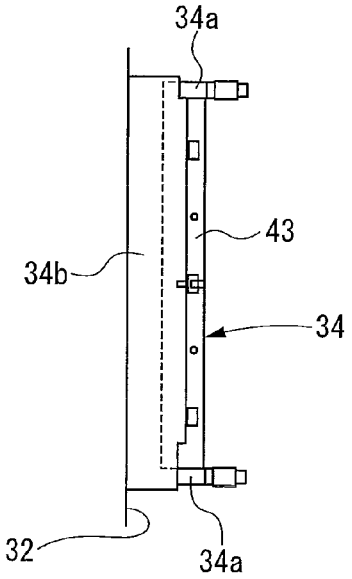
FIG. 3 is a view seen from an arrow B in FIG. 1.
Figure 4:
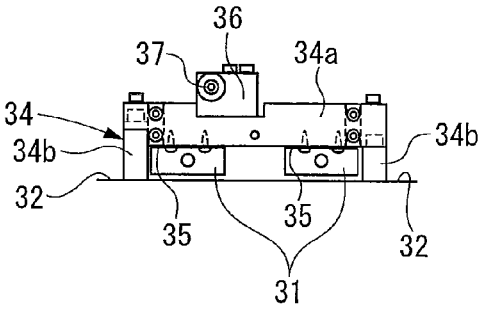
FIG. 4 is a view seen from an arrow C in FIG. 1.
Figure 5:
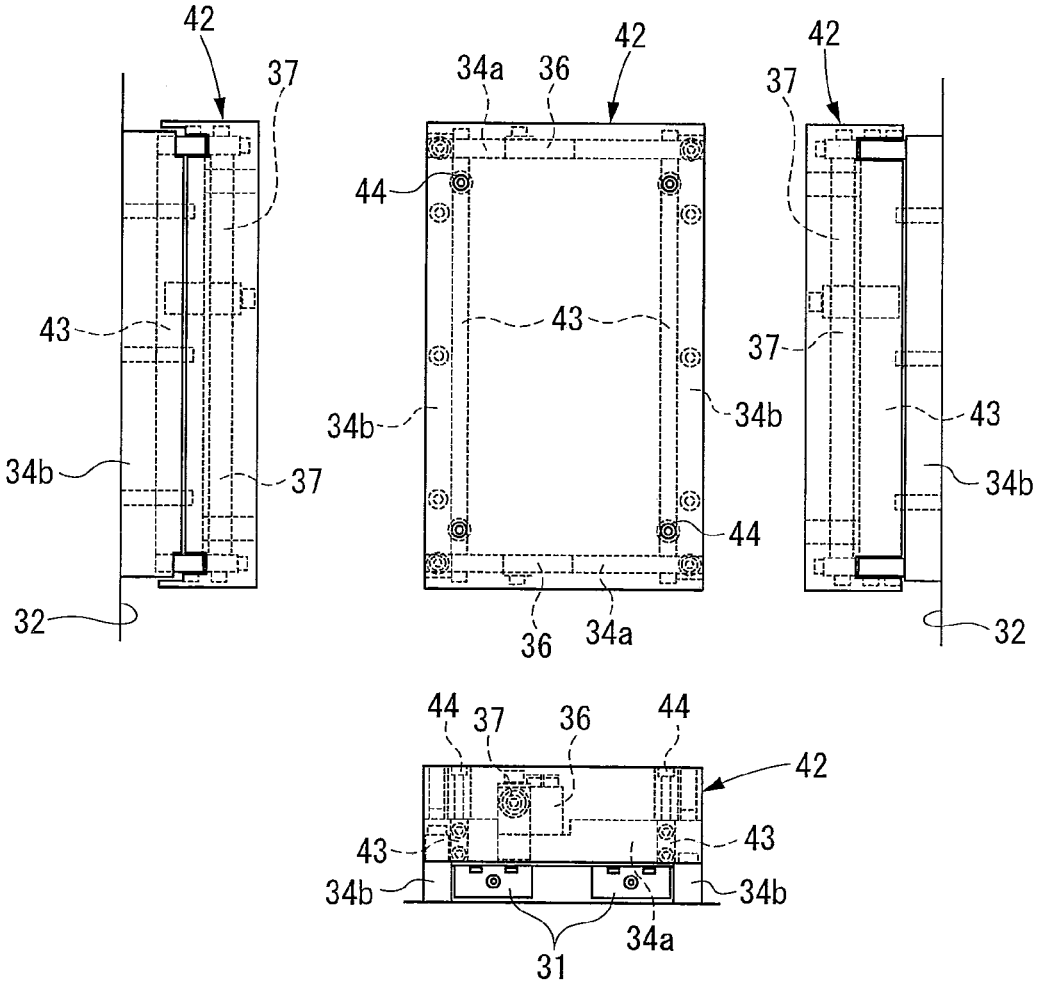
FIG. 5 is a detail view of a cover.
Figure 6:
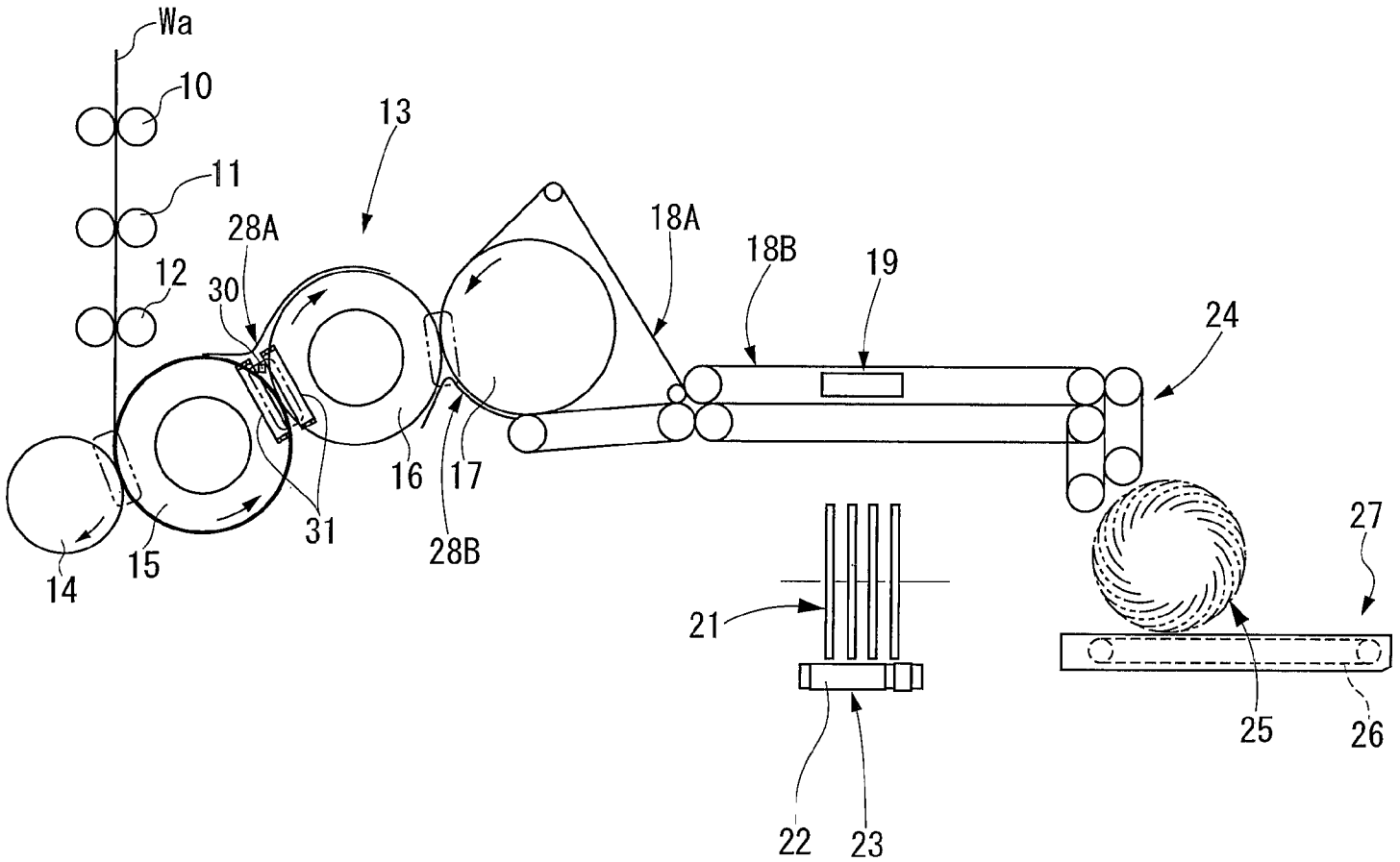
FIG. 6 is a side view of a schematic configuration of the folding machine.
Figure 7:
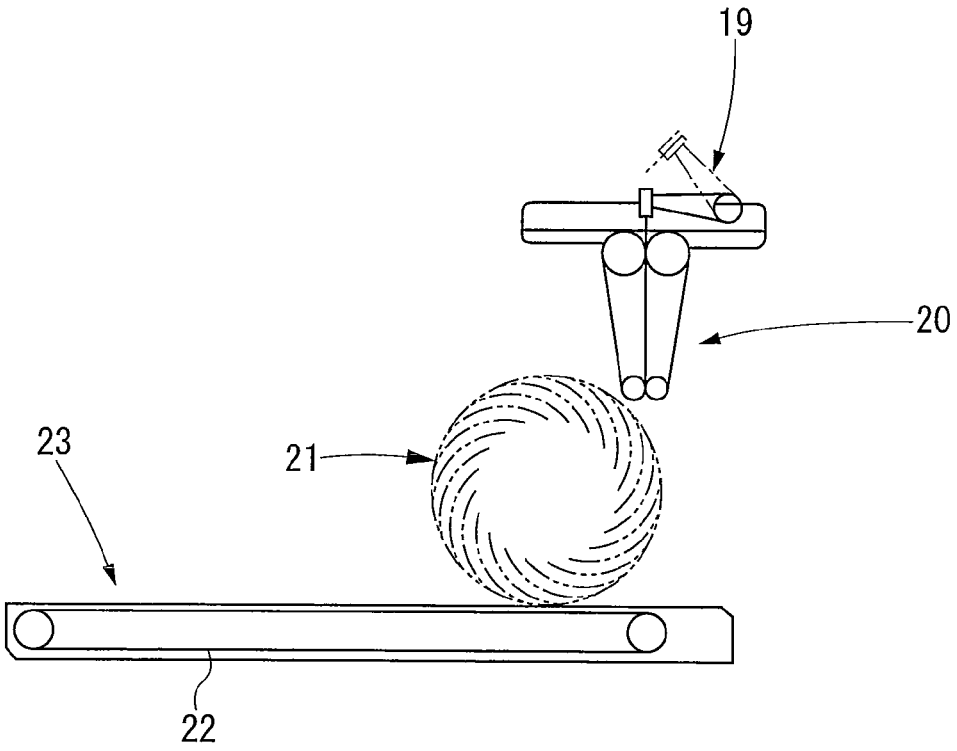
FIG. 7 is a back view of the schematic configuration of the folding machine.
Figure 8A:
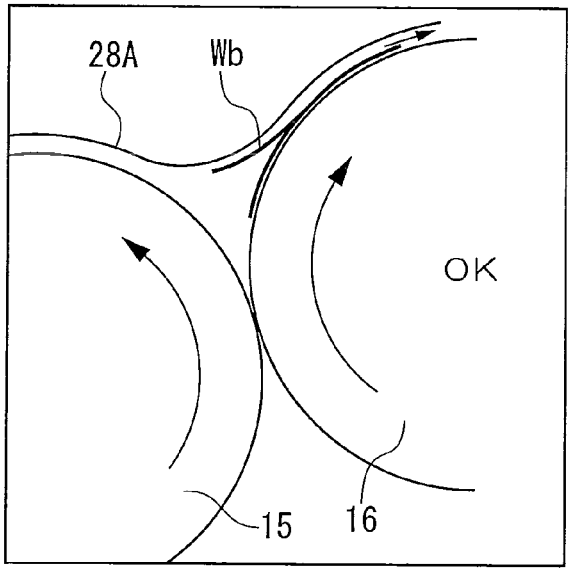
FIG. 8A is an explanatory view of an image showing a good behavior of a signature.
Figure 8B:
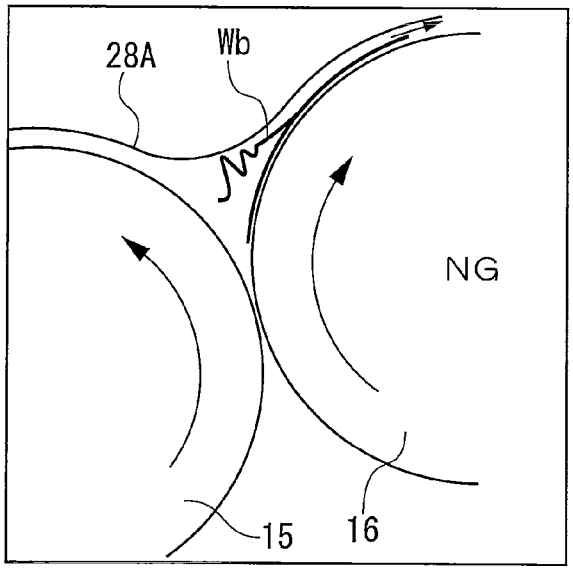
FIG. 8B is an explanatory view of an image showing a bad behavior of a signature.
Figure 9A:
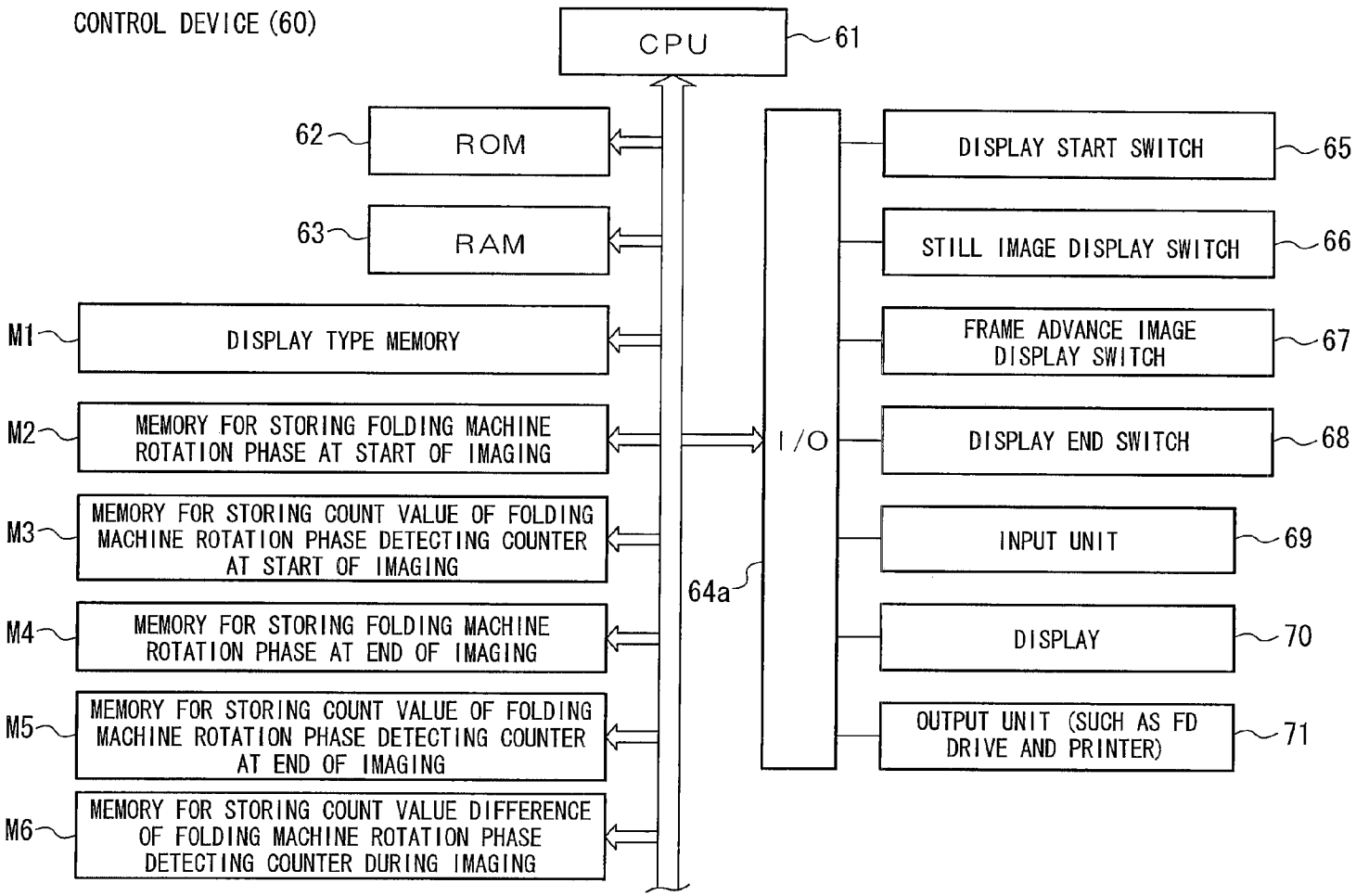
FIG. 9A is a block diagram of a control device.
Figure 9B:
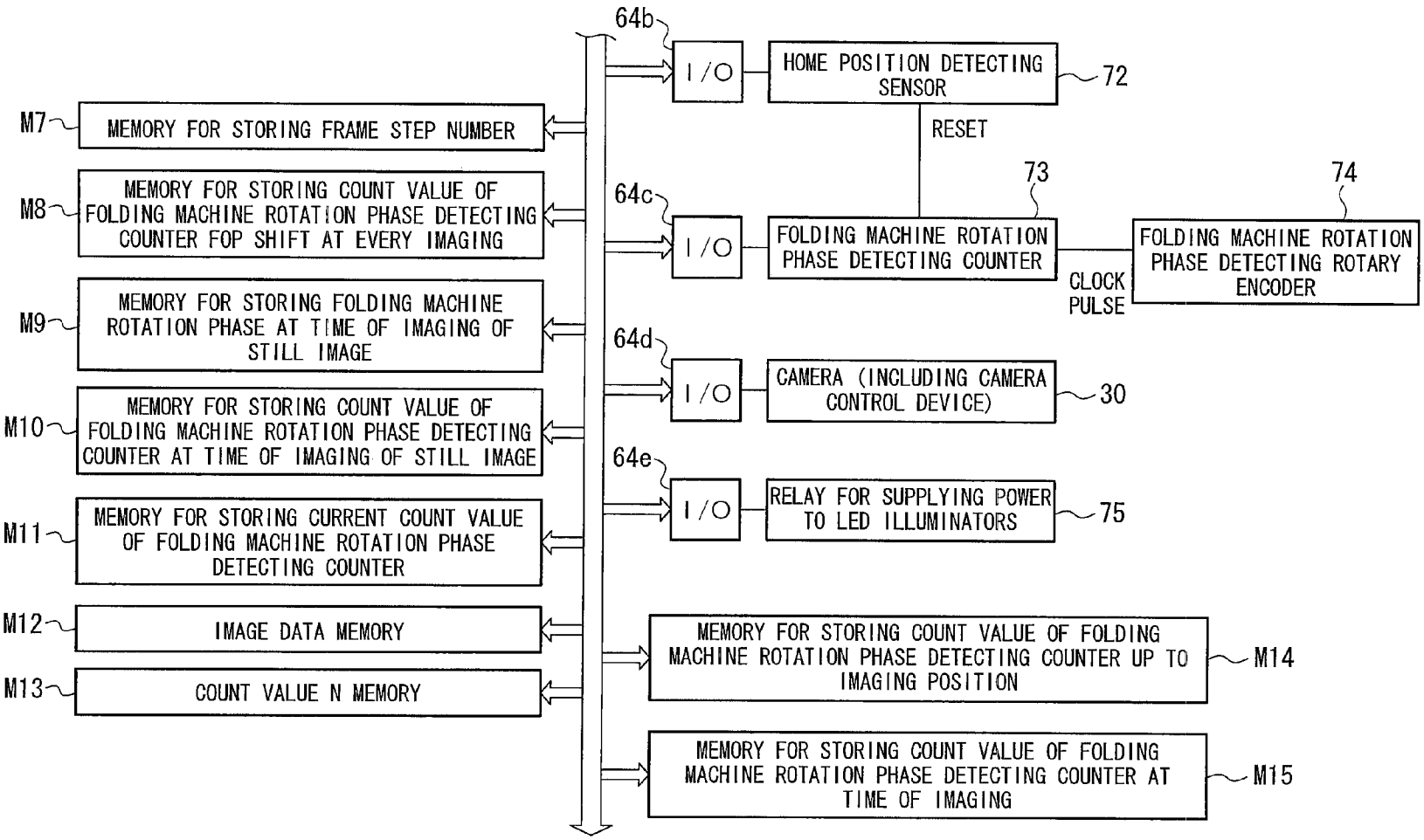
FIG. 9B is a block diagram of the control device.
Figure 10A:
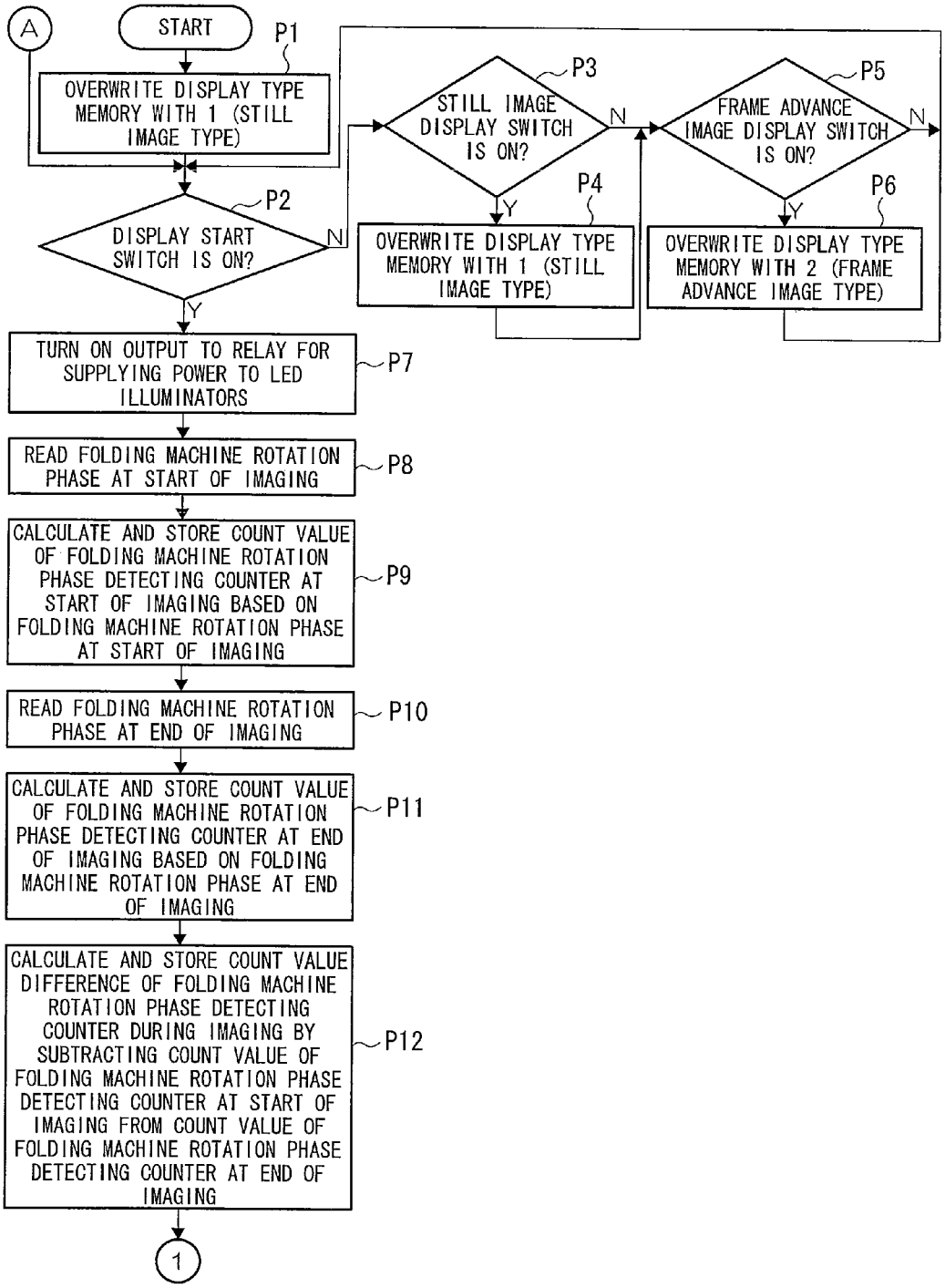
FIG. 10A is a flowchart showing operations of the control device.
Figure 10B:
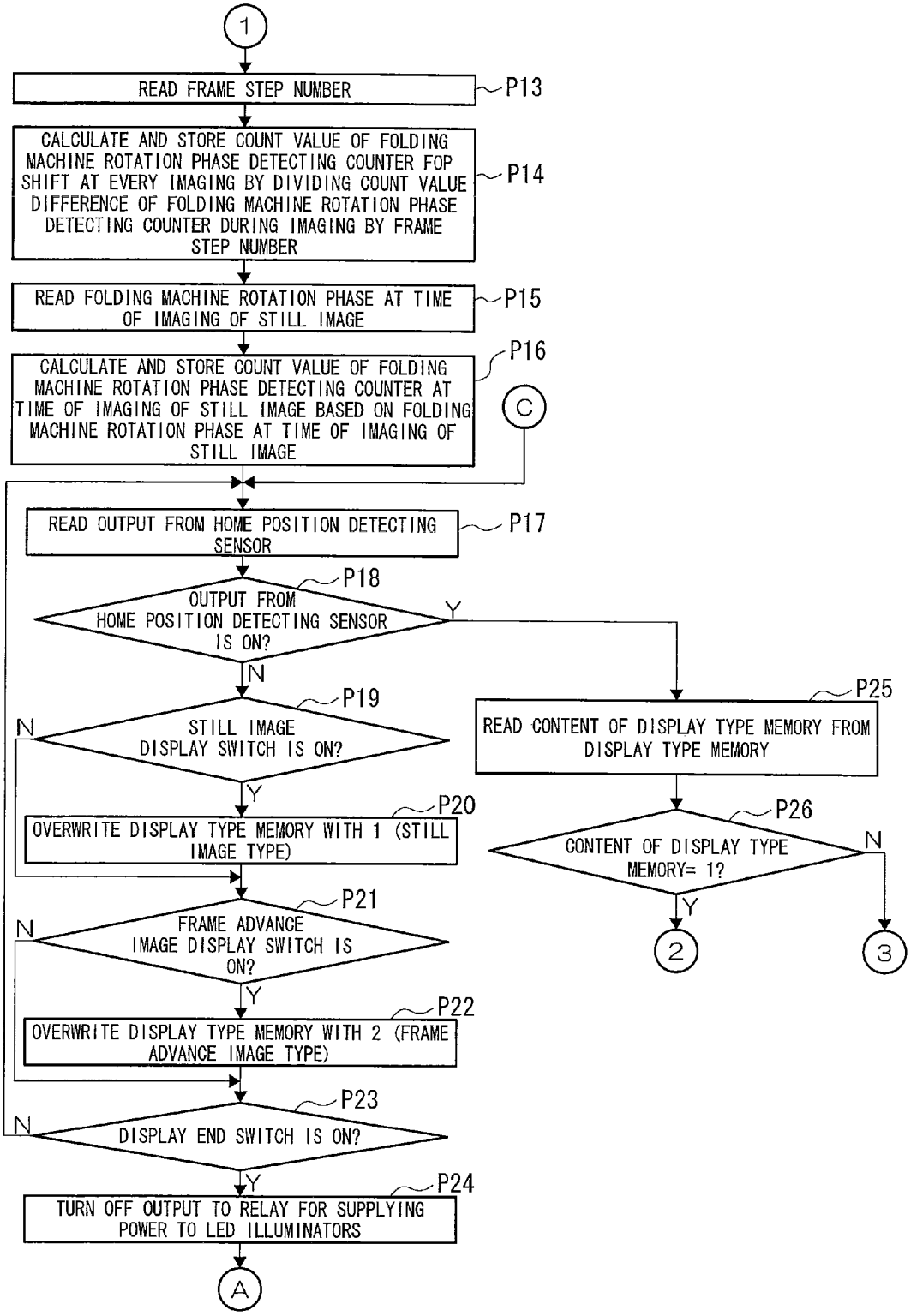
FIG. 10B is a flowchart showing operations of the control device.
Figure 10C:
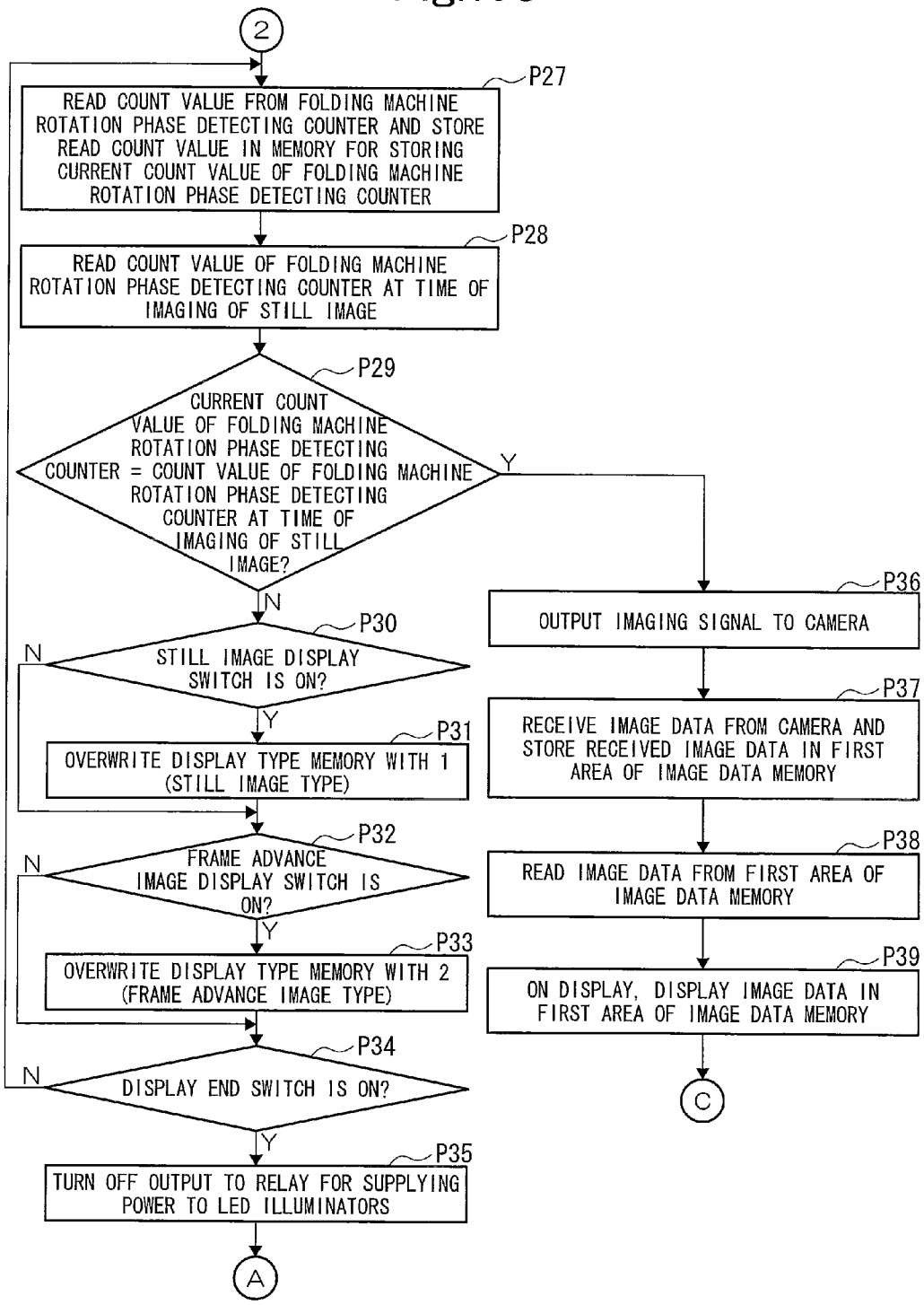
FIG. 10C is a flowchart showing operations of the control device.
Figure 10D:
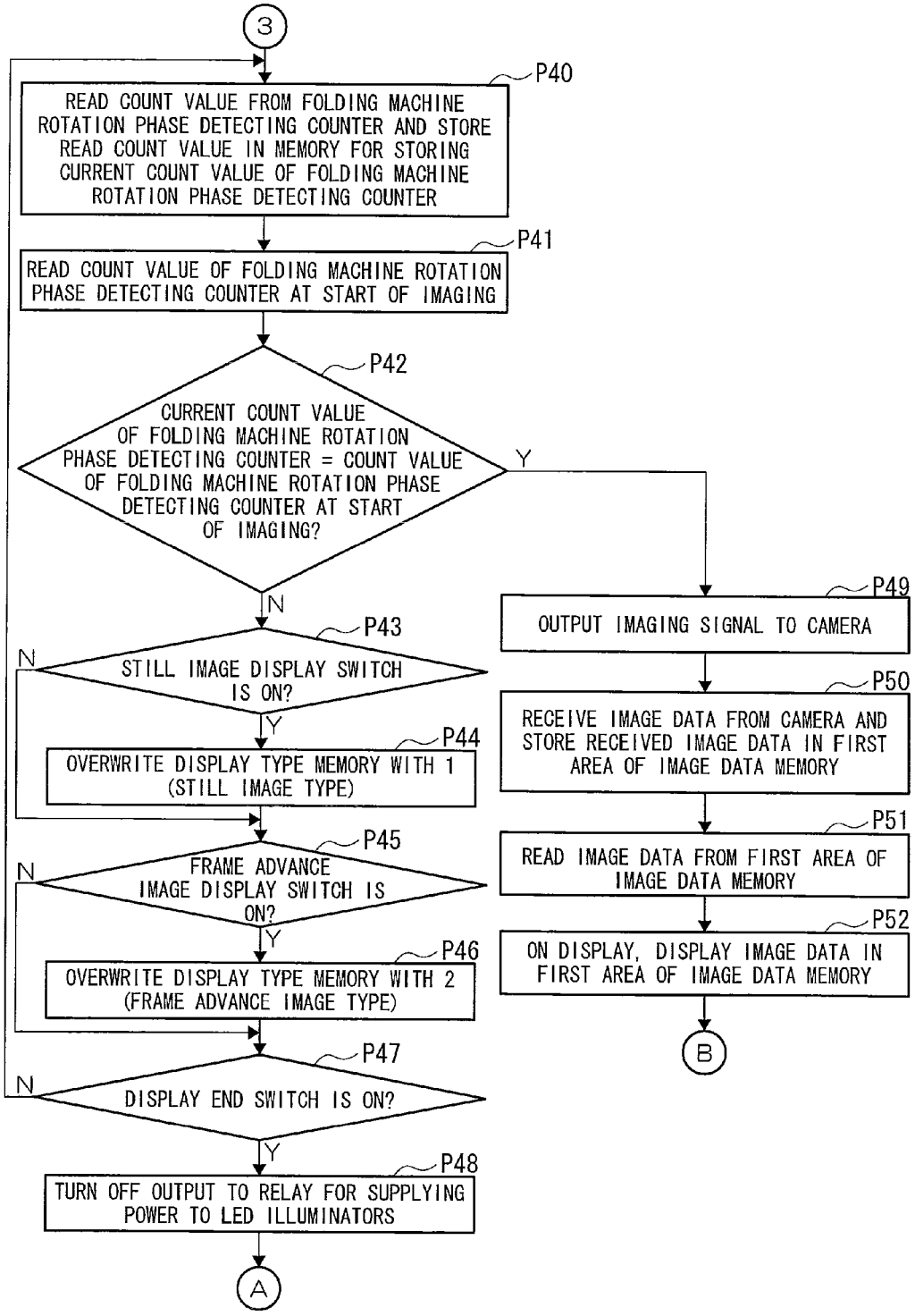
FIG. 10D is a flowchart showing operations of the control device.
Figure 11A:
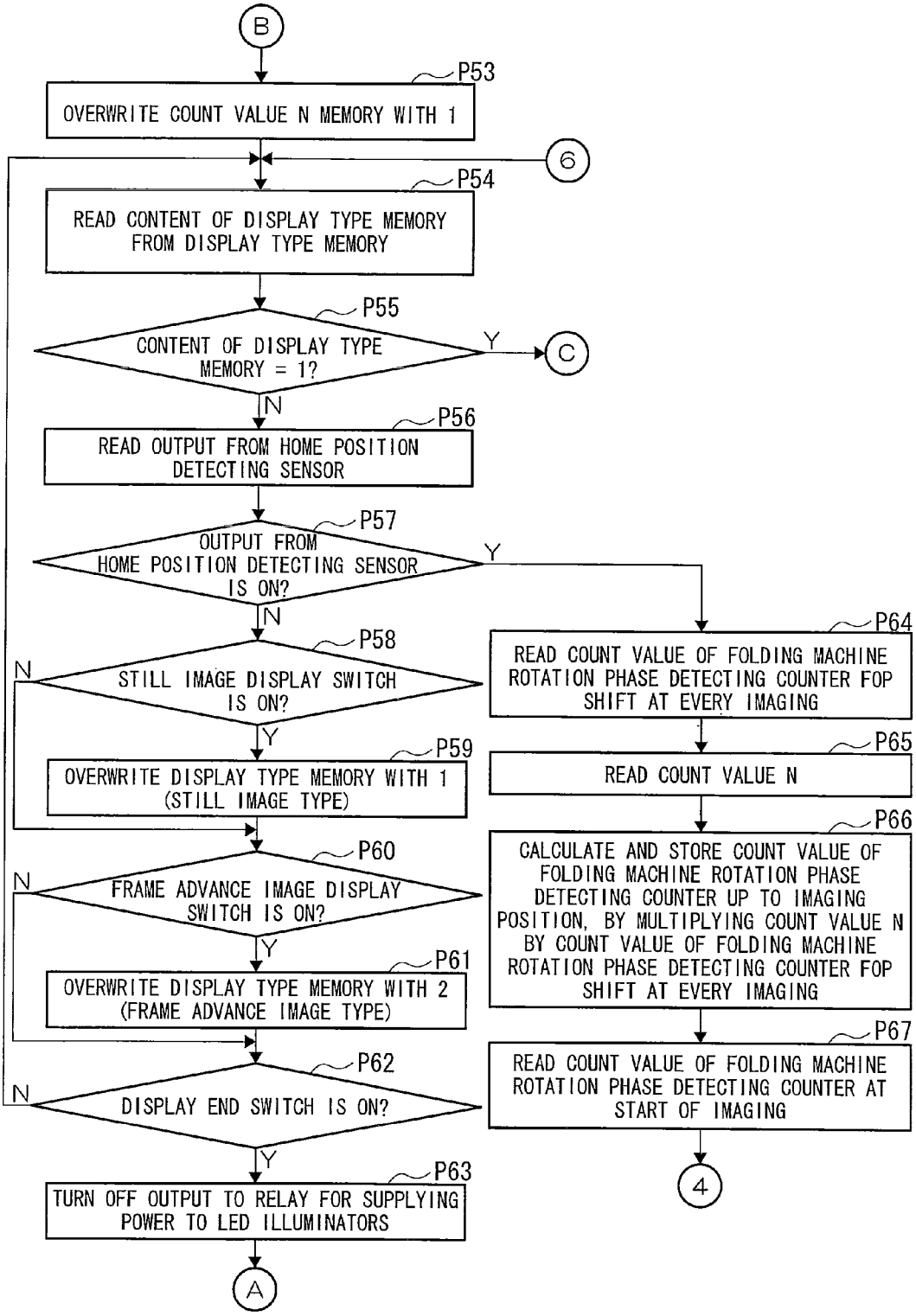
FIG. 11A is a flowchart showing operations of the control device.
Figure 11B:
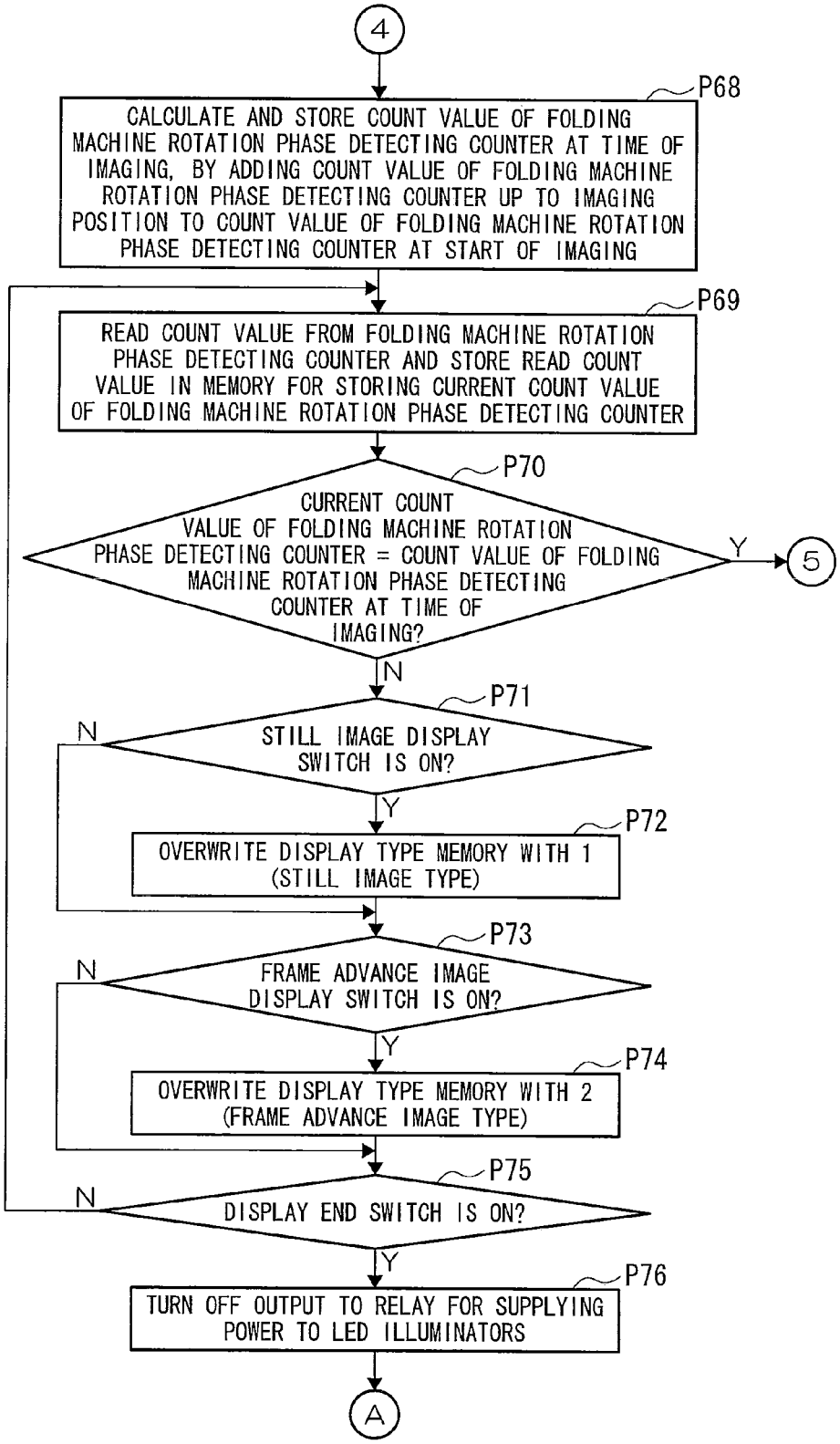
FIG. 11B is a flowchart showing operations of the control device.
Figure 11C:
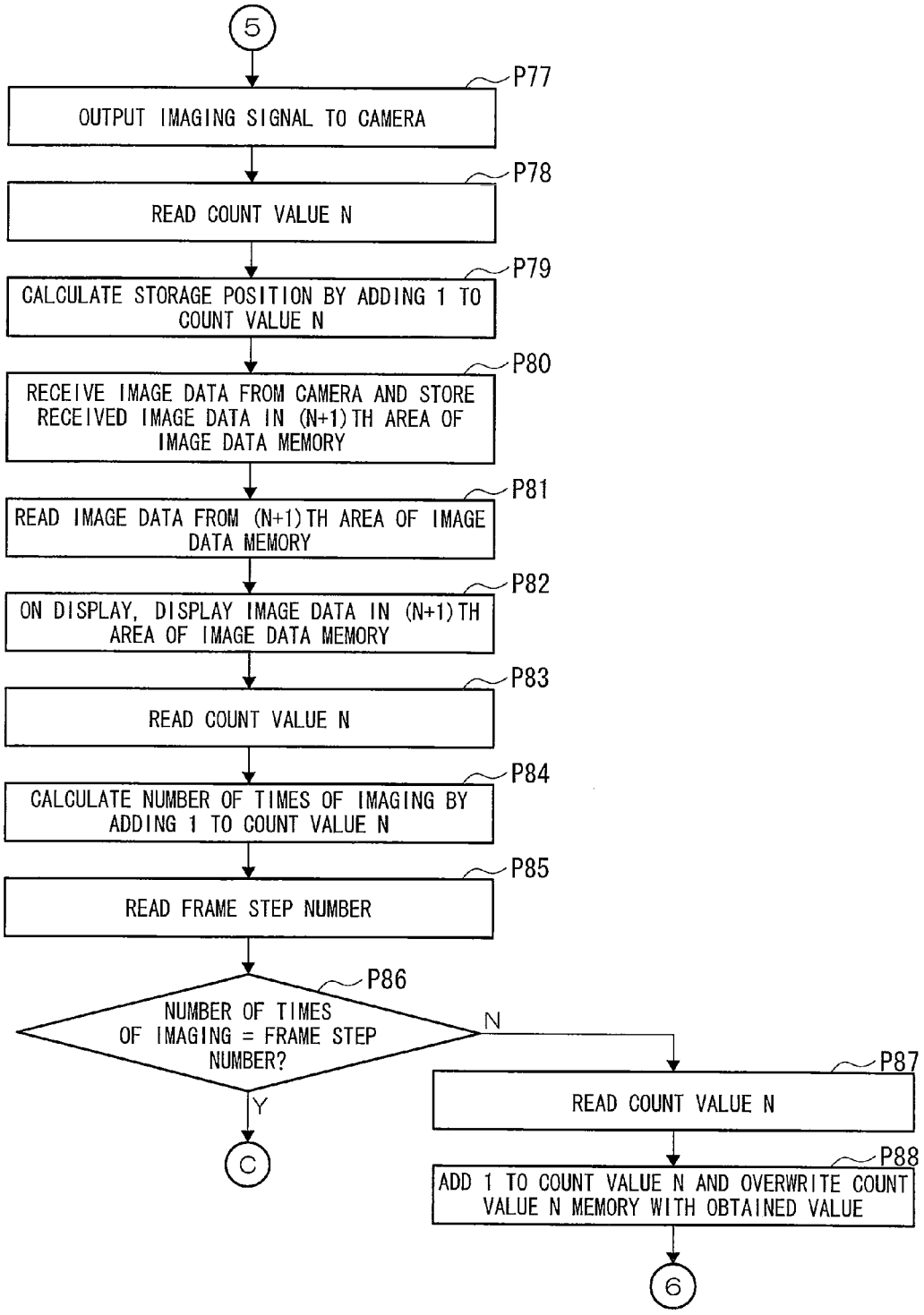
FIG. 11C is a flowchart showing operations of the control device.

FIG. 1 is a side view of a parallel folding device (gripper folding device) in a folding machine according to an embodiment of the present invention. FIG. 2 is a view seen from an arrow A in FIG. 1. FIG. 3 is a view seen from an arrow B in FIG. 1. FIG. 4 is a view seen from an arrow C in FIG. 1. FIG. 5 is a detail view of a cover. FIG. 6 is a side view of a schematic configuration of the folding machine. FIG. 7 is a back view of the schematic configuration of the folding machine. FIG. 8A is an explanatory view of an image showing a good behavior of a signature. FIG. 8B is an explanatory view of an image showing a bad behavior of a signature. FIGS. 9A and 9B are block diagrams of a control device. FIGS. 10A to 10D are flowcharts showing operations of the control device. FIGS. 11A to 11C are flowcharts showing operations of the control device.

As shown in FIGS. 6 and 7, a web Wa cooled and dried after being printed and then guided to an entry part of the folding machine (sheet processor) is transported through a pair of upper nip rollers 10, a pair of cross perforation cylinders 11 and a pair of lower nip rollers 12. Thus, the web Wa is conveyed to a parallel-folding device 13 for cutting or folding the web into a predetermined size.

The parallel-folding device 13 includes a cut-off cylinder 14, a folding cylinder 15, a first jaw cylinder 16 and a second jaw cylinder 17, which are rotated in directions indicated by arrows in FIG. 6, respectively.

The web Wa fed into between the cut-off cylinder 14 and the folding cylinder 15 is cut into a predetermined size by an unillustrated cut-off knife of the cut-off cylinder 14. Moreover, the web Wa is wrapped around a lower circumferential surface of the folding cylinder 15 while being held by an unillustrated needle of the folding cylinder 15.

A signature (sheet) held by the needle is then gripped by an unillustrated gripper board of the first jaw cylinder 16 in cooperation with an unillustrated knife of the folding cylinder 15. Thus, while being folded in two or three, the signature as a signature Wb (see FIGS. 8A and 8B: sheet) is provided on an upper circumferential surface of the first jaw cylinder 16. Note that, a predetermined number of unillustrated knives are also provided at positions that equally divide the circumferential surface of the first jaw cylinder 16.

The second jaw cylinder 17 described above abuts on a downstream side of the first jaw cylinder 16. Moreover, upstream-side conveying belts 18A and downstream-side conveying belts 18B, which are each paired up, are provided at a downstream side of the second jaw cylinder 17. Furthermore, a chopper folding device 19 is provided at a position closer to a front part of the downstream-side conveying belt 18B.

Immediately below the chopper folding device 19, a delivery device 23 for discharging A4 paper, for example, is provided through a pair of left and right conveying belts 20, the delivery device 23 including fan wheels 21 and a conveyor 22. Moreover, at a downstream side of the chopper folding device 19, a delivery device 27 for discharging A3 paper, for example, is provided through a pair of front and rear conveying belts 24, the delivery device 27 including fan wheels 25 and a conveyor 26.

At each of positions that equally divide the circumferential surface of the second jaw cylinder 17, a predetermined number of unillustrated grippers and gripper boards are provided.

Moreover, in the first jaw cylinder 16, an unillustrated cam mechanism is provided. The cam mechanism enables switching between delta-folding and single-parallel and double-parallel folding by switching, in two stages, a rotation phase (position) of a gripper opening in the gripper board of the first jaw cylinder 16.

Here, the folding cylinder 15 has a double-cylinder structure which also enables adjustment of a positional relationship between the unillustrated needle and knife according to the fold specification. Moreover, the second jaw cylinder 17 has an unillustrated cam mechanism which also controls the grippers and gripper boards to be switched in three stages according to the fold specification.

Specifically, in double-parallel folding and delta-folding, the signature is further folded by the knives of the first jaw cylinder 16 and the gripper boards of the second jaw cylinder 17. When the signature is folded, the gripper board of the first jaw cylinder 16 is opened.

Moreover, a first guide plate 28A is provided along circumferential surfaces of the folding cylinder 15 and the first jaw cylinder 16 at a position closer to a downstream side in a rotation direction than a contact point between the folding cylinder 15 and the first jaw cylinder 16. Furthermore, a second guide plate 28B is provided along circumferential surfaces of the first and second jaw cylinders 16 and 17 at a position closer to the downstream side in the rotation direction than a contact point between the first and second jaw cylinders 16 and 17.

Note that, as shown in FIG. 1, the first guide plate 28A includes a guide plate 28Aa for single-parallel folding and double-parallel folding and a guide plate 28Ab for delta-folding.

Moreover, a camera (imaging means) 30 is provided together with a pair of LED illuminators 31. Specifically, the camera 30 takes an image of an end in a conveying direction of the signature (in other words, trailing edge of a sheet), from the same direction as a cylinder shaft direction (see an imaging range E indicated by a chained line in FIGS. 1 and 2) of the first and second jaw cylinders 16 and 17, the end located in a range (so-called delta zone) surrounded by the folding cylinder 15, the first jaw cylinder 16 and the first guide plate 28A.

Specifically, as shown in FIGS. 1 to 4, in a work-side frame 32 of the folding machine, vertically long and rectangular windows 33 are formed in a slightly tilted manner at positions facing, from the cylinder shaft direction of the cylinders, a contact point between the cut-off cylinder 14 and the folding cylinder 15, a contact point between the folding cylinder 15 and the first jaw cylinder 16 and a contact point between the first and second jaw cylinders 16 and 17.

Moreover, a vertically long and rectangular support frame 34 is attached in a slightly tilted manner to an external surface of the frame 32 so as to surround the window 33 facing the contact point between the folding cylinder 15 and the first jaw cylinder 16. Between inner surfaces of a pair of upper and lower lateral frame plates 34*a* of the support frame 34, the pair of front and rear LED illuminators 31 for illuminating the imaging range E described above is suspended through suitable L-shaped brackets 35. Reference numerals 34*b* in the drawings are a pair of front and rear vertical frame plates of the support frame 34.

Between outer surfaces of the pair of upper and lower lateral frame plates 34*a* of the support frame 34, a shaft 37 is suspended by bearing plates 36. On this shaft 37, the camera 30 described above is supported by a first split clamping holder 38 and a second split clamping holder 39. Moreover, a front end side of the camera 30 enters into the window 33.

The first split clamping holder 38 is fixed with a split clamping bolt 40 at any position in a longitudinal direction (vertical direction) on the shaft 37. Moreover, the second split clamping holder 39 is fixed with a split clamping bolt 41 at any angle on a shaft 38*a* attached to the first split clamping holder 38. Specifically, a shooting position and a shooting angle of the camera 30 can be finely adjusted.

As the camera 30, a small monochrome camera with an electronic shutter or the like is used, which realizes high resolution and fast readout, for example.

Moreover, the camera 30, the first and second split clamping holders 38 and 39, the shaft 37 and the bearing plates 36 are covered with a case-like cover 42 as shown in FIG. 5. The cover 42 is fixed with multiple (in the example of FIG. 5, four) bolts 44 to a pair of front and rear auxiliary plates 43 fixed to the support frame 34.

The camera 30 and the LED illuminators 31 are connected to a control device 60 to be described later. The control device 60 can control an imaging timing of the camera 30, switching of display types when an image taken by the camera 30 is displayed on a display 70 such as a CRT and a display, and power supply to the LED illuminators 31.

The display 70 is provided in an operation stand operated by an operator. Therefore, the sheet behavior monitor for the sheet processor is formed of the camera 30, the LED illuminators 31, the control device 60, the display 70 and the like.

The operator monitors in real time the images displayed on the display 70, and determines OK when the conveying direction end of the signature Wb (in other words, the trailing edge of the sheet) in the delta zone is stable along the guide plate 28A, for example, as shown in FIG. 8A. On the other hand, the operator determines NG when instability occurs at the conveying direction end of the signature Wb (in other words, the trailing edge of the sheet) as shown in FIG. 8B. In the case of NG, the rotation speed of the folding machine can be lowered until instability is eliminated, for example.

As shown in FIGS. 9A and 9B, the control device 60 includes a CPU 61, a ROM 62, a RAM 63 and I/O units 64*a* to 64*e*, which are connected to each other via a bus line. A display type memory M1, a memory M2 for storing a folding machine rotation phase at the start of imaging, a memory M3 for storing a count value of a folding machine rotation phase detecting counter at the start of imaging, a memory M4 for storing a folding machine rotation phase at the end of imaging, and a memory M5 for storing a count value of the folding machine rotation phase detecting counter at the end of imaging are connected to the bus line.

A memory M6 for storing a count value difference of the folding machine rotation phase detecting counter during imaging, a memory M7 for storing a frame step number, a memory M8 for storing a count value of the folding machine rotation phase detecting counter for shift at every imaging, a memory M9 for storing a folding machine rotation phase at the time of imaging of a still image, and a memory M10 for storing a count value of the folding machine rotation phase detecting counter at the time of imaging of the still image are further connected to the bus line.

A memory M11 for storing a count value of a counter for detecting a current folding machine rotation phase, an image data memory M12, a count value N memory M13, a memory M14 for storing a count value of the folding machine rotation phase detecting counter up to an imaging position, and a memory M15 for storing a count value of the folding machine rotation phase detecting counter at the time of imaging are further connected to the bus line.

A display start switch 65, a still image display switch 66, a frame advance image display switch 67, a display end switch 68, an input unit 69 such as a keyboard, the display 70 such as the CRT and the display, and an output unit 71 such as a printer and a floppy disk (registered trademark) drive are connected to the I/O unit 64*a*.

A home position detecting sensor 72 is connected to the I/O unit 64*b*. Note that the home position detecting sensor 72 is formed of a photoelectric sensor or the like, and is attached to a rotary member of the folding machine so as to generate a pulse for every rotation of the folding machine. Here, one rotation of the folding machine means a rotation from start of folding of one signature by the folding cylinder 15 and the first jaw cylinder 16 to start of folding of a next signature.

A folding machine rotation phase detecting rotary encoder 74 is connected to the I/O unit 64*c* through a folding machine rotation phase detecting counter 73. The folding machine rotation phase detecting counter 73 is also connected to the home position detecting sensor 72. Note that the folding machine rotation phase detecting rotary encoder 74 is attached to the rotary member of the folding machine so as to be rotated once for every rotation of the folding machine.

The camera (including a camera control device) 30 is connected to the I/O unit 64*d*.

A relay 75 for supplying power to the LED illuminators is connected to the I/O unit 64*e*.

Control operations executed by the control device 60 as described above will be described in detail with reference to FIGS. 10A to 10D and FIGS. 11A to 11C.

First, after the display type memory M1 is overwritten with 1 (still image type) in Step P1, it is determined whether or not the display start switch 65 is ON in Step P2. Here, if a result of the determination is positive, the operation moves to Step P7 to be described later. On the other hand, if the result of the determination is negative, it is determined whether or not the still image display switch 66 is ON in Step P3.

Next, if a result of the determination in Step P3 is positive, the display type memory M1 is overwritten with 1 (still image type) in Step P4. Thereafter, it is determined whether or not the frame advance image display switch 67 is ON in Step P5. On the other hand, if the result of the determination in Step P3 is negative, the operation immediately moves to Step P5.

Thereafter, if a result of the determination in Step P5 is positive, the display type memory M1 is overwritten with 2 (frame advance image type) in Step P6. Thereafter, the operation returns to Step P2. On the other hand, if the result of the determination in Step P5 is negative, the operation immediately returns to Step P2.

When an output to the relay 75 for supplying power to the LED illuminators is turned ON in Step P7 described above, a folding machine rotation phase at the start of imaging is read from the memory M2 in Step P8. Thereafter, a count value of the folding machine rotation phase detecting counter at the start of imaging is calculated based on the folding machine rotation phase at the start of imaging and stored in the memory M3 in Step P9.

Subsequently, after a folding machine rotation phase at the end of imaging is read from the memory M4 in Step P10, a count value of the folding machine rotation phase detecting counter at the end of imaging is calculated based on the folding machine rotation phase at the end of imaging and stored in the memory M5 in Step P11.

Next, in Step P12, a count value difference of the folding machine rotation phase detecting counter during imaging is calculated by subtracting the count value of the folding machine rotation phase detecting counter at the start of imaging from the count value of the folding machine rotation phase detecting counter at the end of imaging, and is stored in the memory M6. Thereafter, in Step P13, a frame step number is read from the memory M7.

Subsequently, in Step P14, a count value of the folding machine rotation phase detecting counter for shift at every imaging is calculated by dividing the count value difference of the folding machine rotation phase detecting counter during imaging by the frame step number, and is stored in the memory M8. Thereafter, in Step P15, a folding machine rotation phase at the time of imaging of a still image is read from the memory M9. Note that the folding machine rotation phase at the time of imaging of the still image is a rotation phase in which a distance of a position of the conveying direction end of the signature Wb (in other words, the trailing edge of the sheet) having no instability from a cylinder circumferential surface of the folding cylinder 15 is set approximately equal to a distance thereof from a cylinder circumferential surface of the first jaw cylinder 16, as shown in FIG. 8A.

Next, in Step P16, a count value of the folding machine rotation phase detecting counter at the time of imaging of the still image is calculated based on the folding machine rotation phase at the time of imaging of the still image, and is stored in the memory M10. By the operation flow described above, the imaging timing for the camera 30 of the both display types (the still image type and the frame advance image type) is initialized.

Next, after an output from the home position detecting sensor 72 is read in Step P17, it is determined whether or not the output from the home position detecting sensor 72 is ON in Step P18. If a result of the determination is positive, the operation moves to Step P25 to be described later. On the other hand, if the result of the determination is negative, it is determined whether or not the still image display switch 66 is ON in Step P19.

Next, if a result of the determination in Step P19 is positive, the display type memory M1 is overwritten with 1 (still image type) in Step P20. Thereafter, it is determined whether or not the frame advance image display switch 67 is ON in Step P21. On the other hand, if the result of the determination in Step P19 is negative, the operation immediately moves to Step P21.

Thereafter, if a result of the determination in Step P21 is positive, the display type memory M1 is overwritten with 2 (frame advance image type) in Step P22. Thereafter, it is determined whether or not the display end switch 68 is ON in Step P23. On the other hand, if the result of the determination in Step P21 is negative, the operation immediately moves to Step P23.

If a result of the determination in Step P23 is positive, the output to the relay 75 for supplying power to the LED illuminators is turned OFF in Step P24 and the operation returns to Step P2. On the other hand, if the result of the determination in Step P23 is negative, the operation returns to Step P17.

Next, after a content of the display type memory M1 is read from the display type memory M1 in Step P25 described above, it is determined whether or not the content of the display type memory=1 in Step P26.

If a result of the determination in Step P26 is positive, a count value is read from the folding machine rotation phase detecting counter 73 in Step P27 and is stored in the memory M11 for storing a count value of a counter for detecting a current folding machine rotation phase. On the other hand, if the result of the determination in Step P26 is negative, the operation moves to Step P40 to be described later.

Next, after the count value of the folding machine rotation phase detecting counter at the time of imaging of the still image is read from the memory M10 in Step P28, it is determined in Step P29 whether or not the count value of the counter for detecting the current folding machine rotation phase is equal to the count value of the folding machine rotation phase detecting counter at the time of imaging of the still image.

If a result of the determination in Step P29 is positive, the operation moves to Step P36 to be described later. On the other hand, if the result of the determination in Step P29 is negative, it is determined whether or not the still image display switch 66 is ON in Step P30. If a result of the determination in Step P30 is positive, the display type memory M1 is overwritten with 1 (still image type) in Step P31. Thereafter, it is determined whether or not the frame advance image display switch 67 is ON in Step P32. On the other hand, if the result of the determination in Step P30 is negative, the operation immediately moves to Step P32.

If a result of the determination in Step P32 is positive, the display type memory M1 is overwritten with 2 (frame advance image type) in Step P33. Thereafter, it is determined whether or not the display end switch 68 is ON in Step P34. On the other hand, if the result of the determination in Step P32 is negative, the operation immediately moves to Step P34.

If a result of the determination in Step P34 is positive, the output to the relay 75 for supplying power to the LED illuminators is turned OFF in Step P35 and the operation returns to Step P2. On the other hand, if the result of the determination in Step P34 is negative, the operation returns to Step P27.

Next, an imaging signal is outputted to the camera 30 in Step P36 described above. Thereafter, in Step P37, image data is received from the camera 30 and is stored in a first area of the image data memory M12.

Subsequently, after the image data is read from the first area of the image data memory M12 in Step P38, the image data in the first area of the image data memory M12 is displayed on the display 70 in Step P39. Thereafter, the operation returns to Step P17.

When the content of the display type memory M1 is 1, in other words, when the still image type is selected as the display type, the loop including Steps P17, P18, P25 to P29 and P36 to P43 executed in this order allows the camera 30 to always take an image in the folding machine rotation phase at the time of imaging of the still image and also allows the display 70 to display those images. Thus, the image data is displayed on the display 70 as if still images were displayed thereon.

Next, in Step P40 described above, the count value is read from the folding machine rotation phase detecting counter 73 and is stored in the memory M11 for storing the count value of the counter for detecting the current folding machine rotation phase. Thereafter, in Step P41, the count value of the folding machine rotation phase detecting counter at the start of imaging is read from the memory M3.

Next, it is determined in Step P42 whether or not the count value of the counter for detecting the current folding machine rotation phase is equal to the count value of the folding machine rotation phase detecting counter at the start of imaging. If a result of the determination in Step P42 is positive, the operation moves to Step P49 to be described later. On the other hand, if the result of the determination in Step P42 is negative, it is determined whether or not the still image display switch 66 is ON in Step P43.

If a result of the determination in Step P43 is positive, the display type memory M1 is overwritten with 1 (still image type) in Step P44. Thereafter, it is determined whether or not the frame advance image display switch 67 is ON in Step P45. On the other hand, if the result of the determination in Step P43 is negative, the operation immediately moves to Step P45.

If a result of the determination in Step P45 is positive, the display type memory M1 is overwritten with 2 (frame advance image type) in Step P46. Thereafter, it is determined whether or not the display end switch 68 is ON in Step P47. On the other hand, if the result of the determination in Step P45 is negative, the operation immediately moves to Step P47.

If a result of the determination in Step P47 is positive, the output to the relay 75 for supplying power to the LED illuminators is turned OFF in Step P48 and the operation returns to Step P2. On the other hand, if the result of the determination in Step P47 is negative, the operation returns to Step P40.

Next, an imaging signal is outputted to the camera 30 in Step P49 described above. Thereafter, in Step P50, image data is received from the camera 30 and is stored in the first area in the image data memory M12.

Next, after the image data is read from the first area of the image data memory M12 in Step P51, the image data in the first area of the image data memory M12 is displayed on the display 70 in Step P52. Thereafter, the operation moves to Step P53 to be described later.

Next, after the count value N memory M13 is overwritten with 1 in Step P53 described above, a content of the display type memory M1 is read from the display type memory M1 in Step P54.

Thereafter, it is determined whether or not the content of the display type memory is equal to 1 in Step P55. If a result of the determination in Step P55 is positive, the operation returns to Step P17. On the other hand, if the result of the determination in Step P55 is negative, an output from the home position detecting sensor 72 is read in Step P56.

Subsequently, it is determined whether or not the output from the home position detecting sensor 72 is ON in Step P57. If a result of the determination in Step P57 is positive, the operation moves to Step P64 to be described later. On the other hand, if the result of the determination in Step P57 is negative, it is determined whether or not the still image display switch 66 is ON in Step P58.

Next, if a result of the determination in Step P58 is positive, the display type memory M1 is overwritten with 1 (still image type) in Step P59. Thereafter, it is determined whether or not the frame advance image display switch 67 is ON in Step P60. On the other hand, if the result of the determination in Step P58 is negative, the operation immediately moves to Step P60.

If a result of the determination in Step P60 is positive, the display type memory M1 is overwritten with 2 (frame advance image type) in Step P61. Thereafter, it is determined whether or not the display end switch 68 is ON in Step P62. On the other hand, if the result of the determination in Step P60 is negative, the operation immediately moves to Step P62.

If a result of the determination in Step P62 is positive, the output to the relay 75 for supplying power to the LED illuminators is turned OFF in Step P63 and the operation returns to Step P2. On the other hand, if the result of the determination in Step P62 is negative, the operation returns to Step P54.

Subsequently, in Step P64 described above, the count value of the folding machine rotation phase detecting counter for shift at every imaging is read from the memory M8. Thereafter, the count value N is read from the memory M13 in Step P65.

Next, in Step P66, a count value of the folding machine rotation phase detecting counter up to an imaging position is calculated by multiplying the count value N by the count value of the folding machine rotation phase detecting counter for shift at every imaging, and is stored in the memory M14. Thereafter, in Step P67, the count value of the folding machine rotation phase detecting counter at the start of imaging is read from the memory M3.

Next, in Step P68, a count value of the folding machine rotation phase detecting counter at the time of imaging is calculated by adding the count value of the folding machine rotation phase detecting counter up to the imaging position to the count value of the folding machine rotation phase detecting counter at the start of imaging, and is stored in the memory M15. Thereafter, in Step P69, a count value is read from the folding machine rotation phase detecting counter 73 and is stored in the memory M1 for storing a count value of the counter for detecting a current folding machine rotation phase.

Thereafter, it is determined in Step P70 whether or not the count value of the counter for detecting the current folding machine rotation phase is equal to the count value of the folding machine rotation phase detecting counter at the time of imaging. If a result of the determination in Step P70 is positive, the operation moves to Step P77 to be described later. On the other hand, if the result of the determination in Step P70 is negative, it is determined whether or not the still image display switch 66 is ON in Step P71.

If a result of the determination in Step P71 is positive, the display type memory M1 is overwritten with 1 (still image type) in Step P72. Thereafter, it is determined whether or not the frame advance image display switch 67 is ON in Step P73. On the other hand, if the result of the determination in Step P71 is negative, the operation immediately moves to Step P73.

If a result of the determination in Step P73 is positive, the display type memory M1 is overwritten with 2 (frame advance image type) in Step P74. Thereafter, it is determined whether or not the display end switch 68 is ON in Step P75. On the other hand, if the result of the determination in Step P73 is negative, the operation immediately moves to Step P75.

If a result of the determination in Step P75 is positive, the output to the relay 75 for supplying power to the LED illuminators is turned OFF in Step P76 and the operation returns to Step P2. On the other hand, if the result of the determination in Step P75 is negative, the operation returns to Step P69.

Next, after an imaging signal is outputted to the camera 30 in Step P77 described above, the count value N is read from the memory M13 in Step P78.

Thereafter, in Step P79, a storage position is calculated by adding 1 to the count value N. Subsequently, in Step P80, image data is received from the camera 30 and is stored in a $(N+1)^{th}$ area in the image data memory M12.

Next, in Step P81, the image data is read from the $(N+1)^{th}$ area in the image data memory M12. Thereafter, in Step P82, the image data in the $(N+1)^{th}$ area in the image data memory M12 is displayed on the display 70.

After the count value N is read from the memory M13 in Step P83, the number of times of imaging is calculated by adding 1 to the count value N in Step P84.

Next, after the frame step number is read from the memory M7 in Step P85, it is determined whether or not the number of times of imaging is equal to the frame step number in Step P86.

If a result of the determination in Step P86 is positive, the operation returns to Step P17. On the other hand, if the result of the determination in Step P86 is negative, the count value N is read from the memory M13 in Step P87. Thereafter, in Step P88, 1 is added to the count value N and the count value N memory M13 is overwritten with the obtained value. Subsequently, the operation returns to Step P54. Thereafter, the above operation is repeated.

When the content of the display type memory M1 is 2, in other words, when the frame advance image type is selected as the display type, the loop including Steps P17, P18, P25, P26, P40 to P42, P49 to P57, P64 to P70 and P77 to P88 executed in this order allows images to be taken by the camera 30 by delaying a timing every time by a period corresponding to a fixed rotation phase and to be sequentially displayed on the display 70 in chronological order. Thus, the image data is displayed on the display 70 as if images were displayed frame by frame thereon. Moreover, the folding machine rotation phase for imaging the frame advance images includes a rotation phase approximately equal to the folding machine rotation phase at the time of imaging of the still image.

The above configuration allows the operator to monitor in real time, based on the images taken by the camera 30, the behaviors (see FIGS. 8A and 8B) of the conveying direction end of the signature Wb (in other words, the trailing edge of the sheet) in the range (so-called delta zone) surrounded by the folding cylinder 15, the first jaw cylinder 16 and the first guide plate 28A. Thus, the operator can promptly make a subsequent response (such as lowering the rotation speed of the folding machine when the behavior is NG). As a result, burden on the operator can be reduced and waste sheets can be reduced.

In this embodiment, the camera 30 takes every image of the signature Wb at a folding machine rotation phase different from that of the image immediately before taken. Thus, the behavior of the signature Wb can be comprehensively grasped. Moreover, the images are not displayed at high speed unlike the case where images of one signature Wb are taken just like normal continuous shots taken by a camera. Thus, the operator can easily recognize the behavior. As a result, monitoring accuracy is significantly improved.

Moreover, the camera 30 takes every image at a later point in the folding machine rotation phase than that of the image immediately before taken. Thus, the behavior of the signature Wb can be recognized along the flow thereof. As a result, the operator can easily recognize the behavior. Note that it is preferable that every image be taken at the later point in the sheet processor rotation phase by a certain rotation phase than that of the image immediately before taken since the behavior of the signature Wb can be more reliably recognized.

Moreover, the display 70 is provided to display the images taken by the camera 30 in chronological order. Thus, the behavior of the signature Wb can be displayed as so-called frame advance images on the display 70. As a result, the operator can easily recognize the behavior.

Moreover, since the display 70 is provided in the operation stand operated by the operator, monitoring by the operator is facilitated.

Note that, needless to say, the present invention is not limited to the above embodiment and various changes can be made without departing from the scope of the present invention. For example, the camera 30 and the LED illuminators 31 may be provided in a range (so-called delta zone) surrounded by the first and second jaw cylinders 16 and 17 and the second guide plate 28B to take images of the behavior of the signature Wb in the range in the case of double-parallel folding or delta-folding, besides the installation location thereof in the above embodiment. Moreover, the present invention is not limited to the folding machine but can be applied to other sheet processors.

REFERENCE SIGNS LIST

13 PARALLEL-FOLDING DEVICE
14 CUT-OFF CYLINDER
15 FOLDING CYLINDER
16 FIRST JAW CYLINDER
17 SECOND JAW CYLINDER
19 CHOPPER FOLDING DEVICE
21 FAN WHEEL
22 CONVEYOR
23 DELIVERY DEVICE FOR DISCHARGING A4 PAPER, FOR EXAMPLE
25 FAN WHEEL
26 CONVEYOR
27 DELIVERY DEVICE FOR DISCHARGING A3 PAPER, FOR EXAMPLE
28A FIRST GUIDE PLATE
30 CAMERA
31 LED ILLUMINATOR
33 WINDOW
34 SUPPORT FRAME
60 CONTROL DEVICE
70 DISPLAY
Wa WEB
Wb SIGNATURE

The invention claimed is:

1. A sheet behavior monitor for a sheet processor, comprising:

a sheet processor processing sheets;

imaging means taking an image of each respective sheet only once for each sheet processed by the sheet processor; and a display, wherein the imaging means takes the image of a respective sheet at a sheet processor rotation phase different from the phase of the image of the sheet taken immediately before by the same imaging means, wherein the imaging means takes the image of the respective sheet at a later point in the sheet processor rotation phase than the phase of the image of the sheet taken immediately before by the same imaging means, the later point in the sheet processor rotation phase is later by a certain rotation phase shift than the phase of the image of the sheet taken immediately before by the same imaging means, and the display displays images, taken by the imaging means, in chronological order.

2. The sheet behavior monitor for a sheet processor according to claim 1, wherein the display is provided in an operation stand operated by an operator.

* * * * *